US006152448A

United States Patent [19]

Cudlipp

[11] Patent Number: 6,152,448

[45] Date of Patent: Nov. 28, 2000

[54] GAME

[76] Inventor: William Owen Cudlipp, 119 George Street, Sydney, NSW 2000, Australia

[21] Appl. No.: 09/212,293

[22] Filed: Dec. 16, 1998

Related U.S. Application Data

[63] Continuation of application No. PCT/AU97/00383, Jun. 17, 1997.

[30] Foreign Application Priority Data

Jun. 17, 1996 [AU] Australia ..... 0506

[51] Int. Cl.[7] ..... A63B 71/00

[52] U.S. Cl. ..... 273/144 R; 273/144 A; 273/144 B

[58] Field of Search ..... 273/144 R, 93 R, 273/144 A, 144 B

[56] References Cited

U.S. PATENT DOCUMENTS

| | | | |
|---|---|---|---|
| 2,001,500 | 5/1935 | Rothen | 273/138 |
| 2,091,883 | 8/1937 | Rochwarg | 273/95 |
| 2,210,201 | 8/1940 | Draper et al. | 273/141 |
| 2,539,216 | 1/1951 | Weinschenk | 273/144 |
| 2,621,042 | 12/1952 | Stein et al. | 272/1 |
| 3,090,623 | 5/1963 | Dugan | 273/142 |
| 3,853,324 | 12/1974 | Reiner et al. | 273/142 E |
| 4,147,352 | 4/1979 | Rosero | 273/93 R |
| 4,373,728 | 2/1983 | Korzenietz . | |
| 4,813,676 | 3/1989 | Weatherspoon | 273/144 A |
| 4,824,113 | 4/1989 | Lange . | |
| 4,846,476 | 7/1989 | Hanna | 273/144 A |
| 5,121,920 | 6/1992 | Laezzo et al. | 273/144 B |

FOREIGN PATENT DOCUMENTS

| | | | |
|---|---|---|---|
| 381521 | 10/1932 | United Kingdom | A63F 5/02 |
| 1113668 | 5/1968 | United Kingdom | A63F 5/02 |

*Primary Examiner*—Sebastino Passaniti
*Assistant Examiner*—Dolores R. Collins
*Attorney, Agent, or Firm*—Liniak, Berenato, Longacre & White, LLC

[57] ABSTRACT

Apparatus suitable for use as a game of chance comprising a first set of elements (2) divisible into two or more visually distinguishable subsets (for example a set of balls divided into a plurality of colours), a second set of destinations divisible into two or more distinguishable subsets (for example a set of compartments on a wheel (23) formed by partitions (26) and divided into subsets distinguished by numerals) and means (10) for selecting at random one element (2*b*) from the first set (for example one ball) and associating the selected element at random with a destination (eg one compartment) of the second set.

23 Claims, 4 Drawing Sheets

GAME

This application is a Continuation of Ser. No. PCT/AU97/00383 filed Jun. 17, 1997.

FIELD OF THE INVENTION

This invention relates to a game and more particularly to a game of chance suitable for use in entertainment of one or more players.

BACKGROUND OF THE INVENTION

Games in which the outcome is determined by chance are well known. Some such games have been specifically designed for play before a television audience. Games of chance may be divided into two groups. In one group, the number of possible outcome combinations is generally very great so that the chance of a match with a particular predetermined combination is very small. As there is typically only one winner per draw the winnings may be a very large multiple of the stake. For example, in "lotto" a succession of counters (each counter bearing a unique number) is drawn at random from a set of counters. The drawing is conducted in a television studio, the result of each draw being displayed to a television audience. To prolong excitement counters may be drawn in succession over a period. If a member of the audience is able to match the drawn number combination with a predetermined combination that audience member is a game winner. In other lotteries a sequence of say 6 digits is drawn to yield a random 6 digit number.

An apparatus suitable for games of this kind is described in U.S. Pat. No. 4,373,728 whereby numbers may be selected at random, for example six numbers may be selected from 40, to designate a winning lottery number. 40 balls, six being of a different colour from the remaining 34, are randomly mixed and then fall at random into a conduit whereby all 40 balls are arranged in a random sequence which is fed in succession into a wheel having peripheral receptacles so that each receptacle receives in succession the next ball of the sequence. Each receptacles is numbered and those numbers corresponding to the six differently coloured balls define the six numbers selected as the random outcome. By turning the wheel slowly the outcome of disclosure of the draw may be prolonged.

Games in the first group have a fixed stake and tend to be perceived by players as having outcome determined solely by luck.

In the second group are games such as roulette, in which fewer combinations are available. With games of this group a player may wager different amounts on chosen outcomes for each "play" or "spin". For example a player may bet on whether the roulette ball will select a particular one of 36 numbered slots, an odd or even number, a black or red number, and so on. In such games the odds in favour of various possible outcomes are readily appreciable so that players feel they can optimise their chances of winning by systematic play and can exercise skill in adjusting wagers according to odds. Such games are considered to be more participatory, engaging and entertaining. Furthermore each spin takes some time extending the excitement of each game. However the maximum odds for any particular wager are generally a small multiple of the wager, for example 35 to 1 for a 36 compartment roulette wheel having one non-paying slot. GB 1,113,668 describes a roulette-type game in which at least two identifiably different balls are used in succession. This facilitates a player placing a "doubles bet" (ie equivalent to betting on the outcome of a combination of two successive plays of the wheel) increasing the range of odds available and extends the excitement over a longer period.

U.S. Pat. No. 4,824,113 describes a game in which six groups of differently coloured balls are randomly mixed in six ganged chambers simultaneously and then when a gate is activated one coloured ball is selected at random from each group yielding a combination of six selected colours. By duplicating colours a range of odds for various combinations can be provided for each spin. Since the outcome after mixing is determined virtually instantaneously after mixing this game lacks the excitement of most games in the second group.

There remains an unsatisfied demand for games which provide an apparent simplicity in assessing the odds of various outcomes, which provide scope for wagers covering a wide range of odds spanning from high to low probability, and which are exciting to play.

OBJECT OF THE INVENTION

It is an object of the present invention to provide a new game which is easy to play and provides an alternative to known games.

DISCLOSURE OF THE INVENTION

According to one aspect the invention consists in apparatus comprising a first set of elements divisible into two or more visually distinguishable subsets, a second set of destinations divisible into two or more distinguishable subsets, means for selecting at random one element from the first set, and means for associating said randomly selected one element at random with one destination of the second set.

In a preferred embodiment of the invention the first set of elements are balls divided into a plurality of subsets, each subset of balls being of a colour or appearance differing from each other subset. A ball selected at random from the first set is allowed to fall at random onto a wheel having a plurality of destinations for example a wheel divided partitioned into numbered segmental compartments. The randomly selected ball of the first set is allowed to bounce until it settles into one of the compartments. It thereby becomes associated at random with one or another numbered destination (compartment) of the set of destinations (compartments) of the wheel. A player who is able in advance of the game to guess at the colour of the ball selected and/or to guess the number of the compartment into which the ball settles is a winner. Players may wager on which coloured ball is selected from the first set, or on which destination the selected ball becomes associated with, or on a combination of ball colour and destination.

BRIEF DESCRIPTION OF THE DRAWINGS

An embodiment of the invention will now be described by way of example only with reference to the accompanying drawings wherein:

With reference to FIG. 1 there is shown schematically (and not to scale) the general arrangement of a first embodiment according to the invention in cross-section in a vertical plane. A transparent generally cylindrical first chamber 1 contains a first set of balls 2 which are variously coloured.

Figure 5:
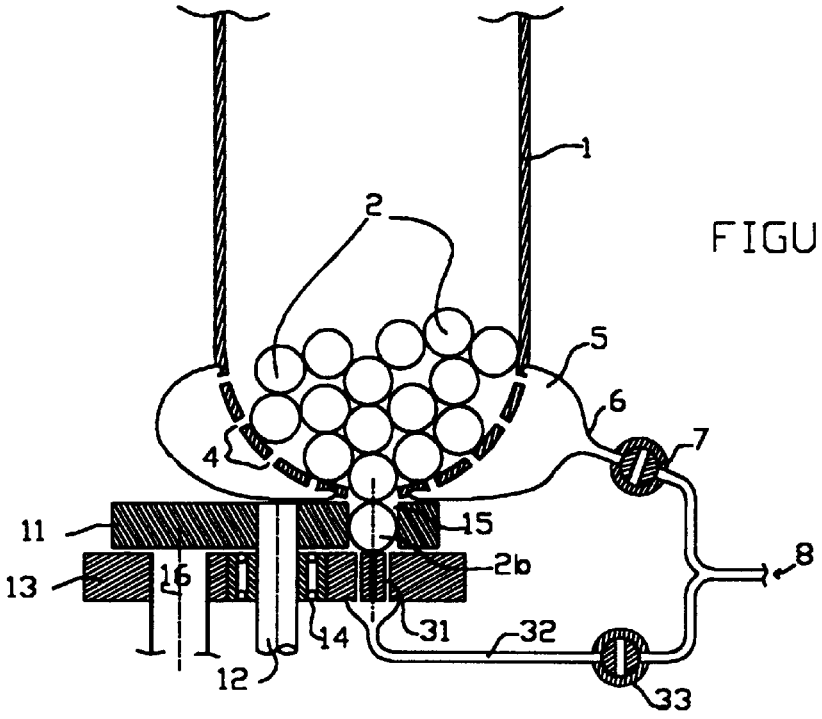
FIG. 5 shows a scrap portion of the embodiment of FIG. 1 in a first stage of operation, FIG. 6 corresponds to FIG. 5 but in a second stage of operation.

Balls 2 are desirably of light weight (eg hollow) and are resilient (eg of plastic). First chamber 1 has a hemispherical or conical floor draining at its lowest portion to an opening 3 through which a ball 2 may be admitted or discharged from chamber 1. The floor of chamber 1 is provided with a plurality of openings or air jets 4 which communicate via a manifold 5, tubular connection 6, and valve 7, with a compressed air supply indicated at 8. When valve 7 is opened (FIG. 1) air under pressure is blown into chamber 1 via jets 4 levitating balls 2 which resiliently rebound from collisions with each other and/or with the walls of chamber 1 whereby balls 2 become randomly mixed. When valve 7 is closed, balls 2 fall in a random mixture to the floor of chamber 1 (as shown in FIG. 5).

Figure 1:
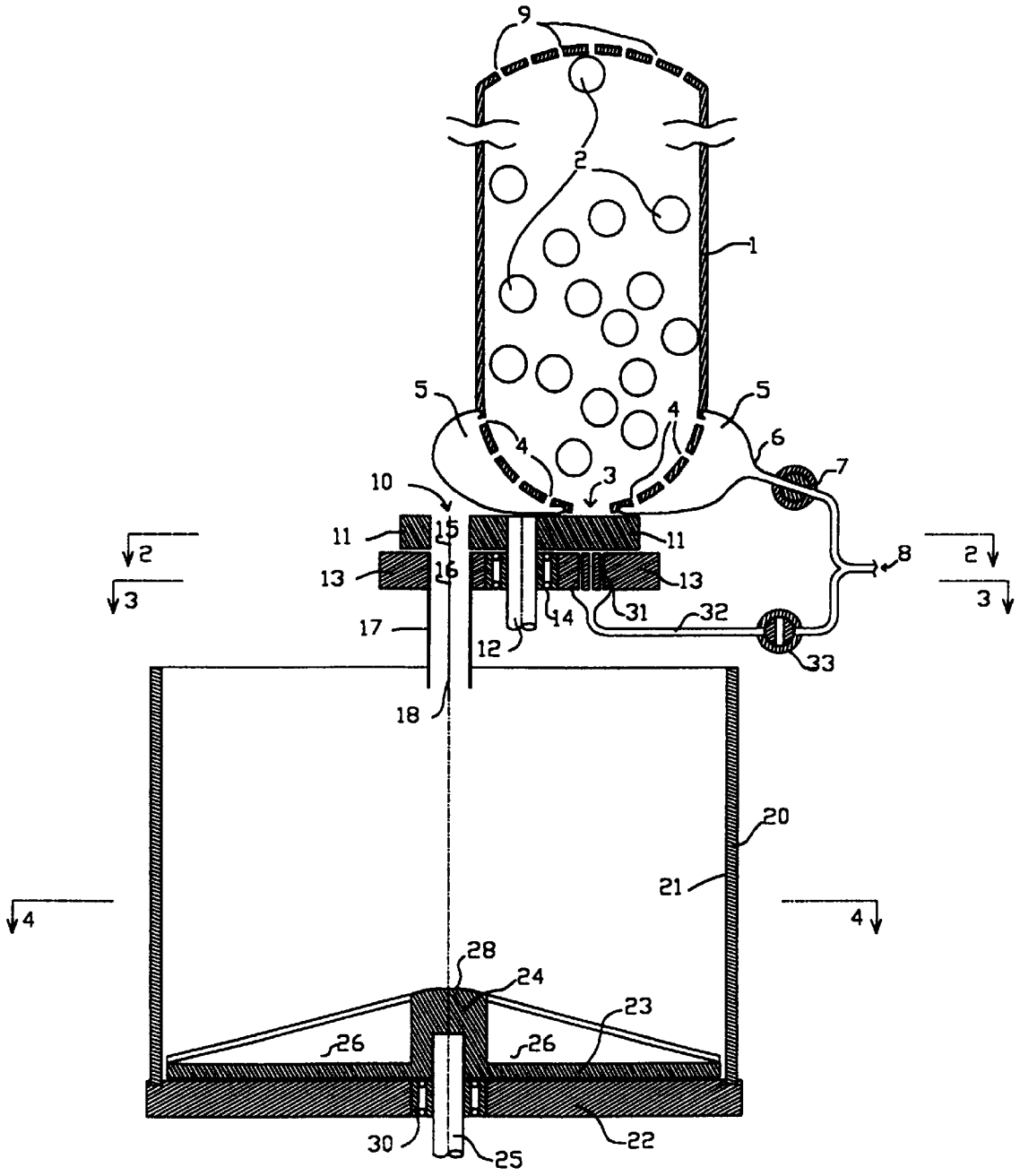
FIG. 1 schematically illustrates a first embodiment of the invention in section in a vertical plane.
Figure 2:
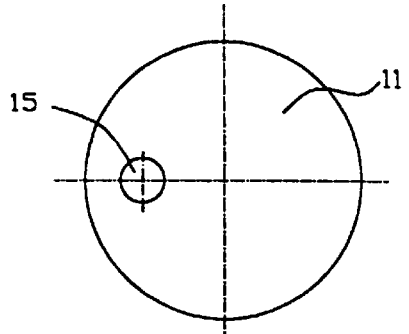
FIG. 2 shows a section on line 2—2 of FIG. 1 viewed in plan.

Opening 3 can be closed (as illustrated in FIG. 1) by a gate 10. Gate 10 comprises a circular disc 11 mounted for driven rotation by means of a shaft 12 about an axis parallel to the cylindrical axis of chamber 1. Disc 11 is mounted overlying a plate 13 having an area greater than that of disc 11 and is separated from plate 13 by a small clearance. Shaft 12 extends through plate 13 and is journaled in a bearing 14 mounted to plate 13. Disc 11 is of a thickness equal to or slightly greater than the diameter of balls 2 and is penetrated by a bore 15 of a diameter sufficient to receive a single ball 2 with clearance therein.

Disc 11 is rotatable via shaft 12 (by means not illustrated) between a first (or "open") position and a second (or "closed") position. In the first position, as shown in FIG. 5 bore 15 of disc 11 underlies and is in substantial registration with opening 3 of chamber 1 whereby bore 15 is open to chamber 1. When balls 2 are supported by the floor of chamber 1 (ie are not levitated by air pressure) one ball **2*b* may drain into bore 15 of disc 11. Disc 11 may then be driven via shaft 12 (by means not illustrated) to a second position (which in the embodiment illustrated is rotated through 180° from the first position for clarity, but which may be at a much smaller angle from the first position). Ball 2*b* in bore 15 is thereby rolled to the second position. In the second position (FIG. 6) bore 15 overlies an orifice 16 in lower plate 13. When registration of bore 15 and orifice 16 is achieved, ball 2*b* in bore 15 falls through orifice 16 into a tubular chute 17. When disc 11 is not in the first position opening 3 of chamber 1 is closed by disc 11**.

Underlying outlet 18 of tube 17 and disposed coaxially therewith is a second hollow cylindrical chamber 20 having a transparent cylindrical wall 21 and a circular floor 22. A wheel 23 having a central cylindrical boss 24 with a circular upper surface 28 is mounted for driven rotation coaxially within cylinder 20 by attachment to a shaft 25 which extends axially though an aperture of cylinder floor 22 and is journaled in a bearing 30 mounted to the floor of cylinder 20.

Figure 3:
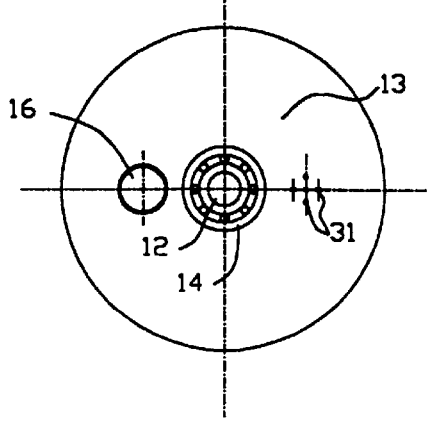
FIG. 3 shows a section on line 3—3 of FIG. 1 viewed in plan.
Figure 4:
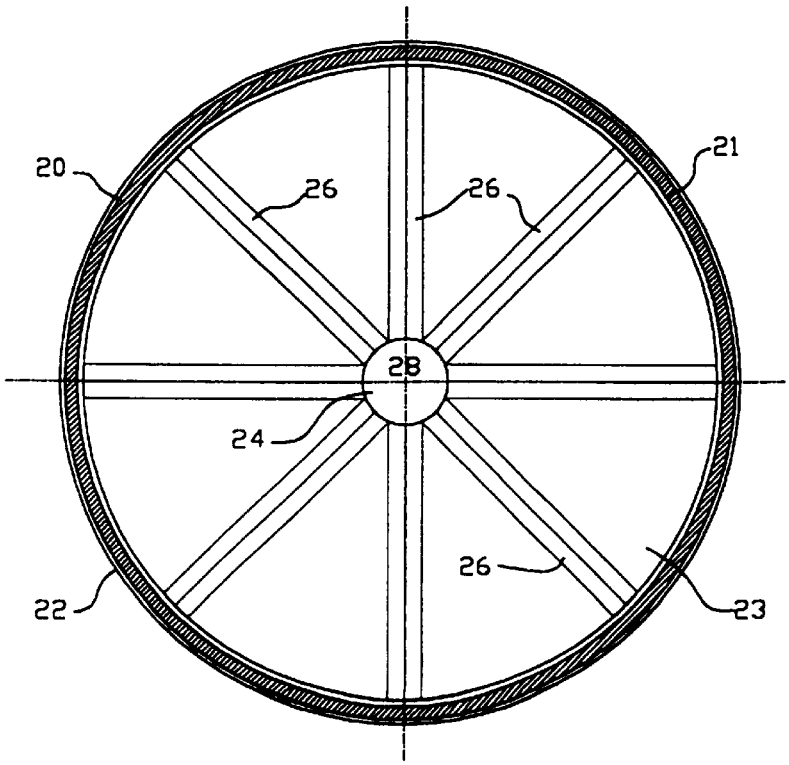
FIG. 4 shows a section on line 4—4 of FIG. 1 viewed in plan.

Wheel 23 is of a clearance diameter less than the internal diameter of floor 22 and when viewed from above (see FIG. 3) is divided into upwardly open compartments by means of walls 26 which extend radially from boss 24 to the periphery of wheel 23. In a preferred embodiment there are 25 compartments of equal area and each wall is higher near the boss than near the periphery.

Outlet 18 is centred vertically over the centre of the upper surface 28 of boss 24.

In operation chamber 1 initially contains a plurality of balls 2 of various colours. Gate 10 is closed, and valve 7 is closed.

Valve 7 is then opened admitting compressed air to passage 6 and jets 4 causing balls 2 to levitate and to be flung resiliently against the spherical interior wall of chamber 1 and/or against each other to randomly mix the balls in chamber 1 (FIG. 1). Chamber 1 is provided with vent holes 9 whereby spent air exits from the chamber.

Figure 6:
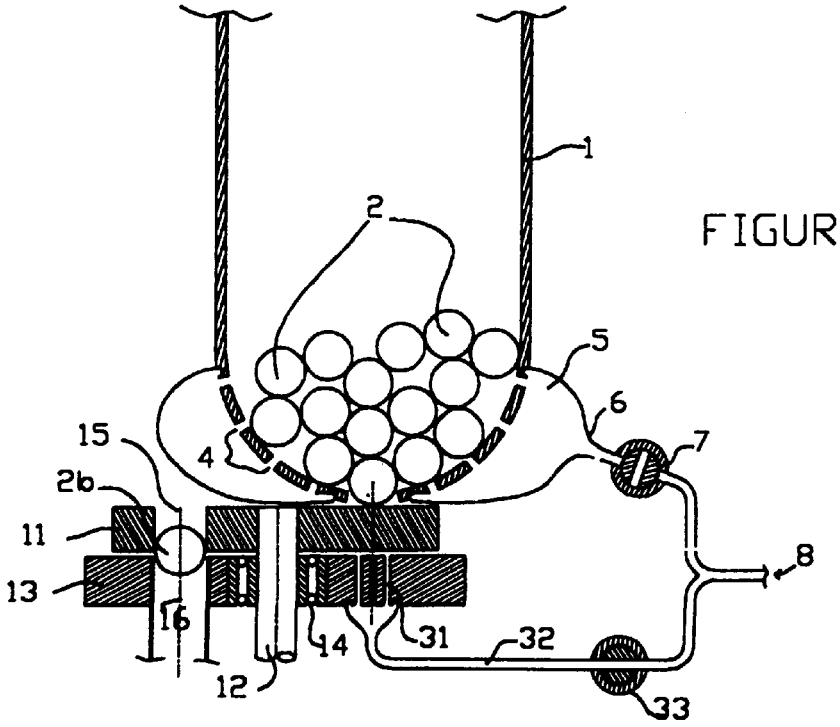

When the balls have been randomly mixed in chamber 1, gate 10 is opened by rotating disk 11 to align bore 15 with opening 3 (FIG. 5). At this time wheel 24 in chamber 20 is set spinning freely (for example by an electric or air driven motor and clutch, not illustrated, or manually) and valves 7, 33 are closed allowing balls 2 to fall at random to the floor of chamber 1. One ball, designated **2*b* in FIG. 5, falls into bore 15 of disc 11 and is supported on plate 17. Disc 11 is then rotated (by means not illustrated) to a second position (FIG. 6) in which bore 15 is in registration with orifice 16 (FIG. 6). Ball 2*b* is thereby rolled to, and falls through, orifice 16. By this means a single ball 2*b* is selected at random from the balls in chamber 1**.

Figure 7:
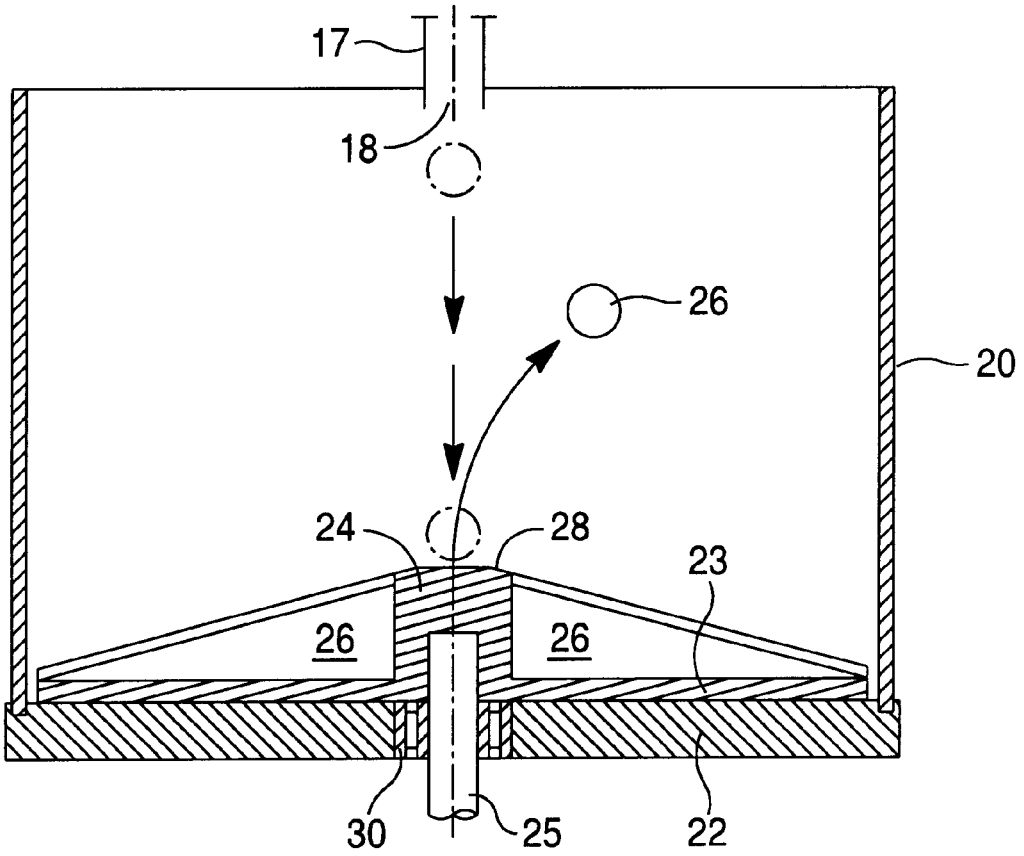
FIG. 7 shows a scrap portion of FIG. 1 in a third stage of operation.

The selected ball falls downwardly onto flat surface 28 of boss 24 of wheel 23 (FIG. 7). For preference the elasticity of the balls is such that on striking surface 28 ball **2*b* rebounds and, depending on the dimensions of the apparatus may bound upwards then falling directly onto wheel 23, or may be flung against cylinder wall 21 and then bounce to fall back towards wheel 23. The ball may subsequently bounce from collision with the boss, the floor of wheel 23, or from collision with partition walls 26. However, as the wheel slows the ball will eventually settle at random in one or another of the compartments defined between walls 26**.

The compartment in which the randomly selected ball remains determines the outcome of the game. Player may wager on which coloured ball is selected from chamber 1 and falls into chamber 20 or on which compartment the ball settles into on wheel 23 or on the combination.

Plate 13 is desirably provided with air vents 31 connected via a tube 32 with air supply 8 either via valve 7, or via an independent valve 33, whereby bore 15 may be cleared prior to closing gate 10 from the open to the closed position.

Although for illustrative simplicity only a few balls are shown in the embodiment of FIGS. 1–6, in a preferred embodiment of the invention there are 88 balls in chamber 1 and spinning wheel 23 has 25 compartments.

The 88 balls are of various colours for example:

| COLOUR | NUMBER |
|---|---|
| Red | 39 |
| Green | 25 |
| Purple | 15 |
| Orange | 8 |
| Stripe | 1 |
| Total | 88 |

When on coloured ball falls onto the wheel a successful bet on the colour of the ball pays the following odds

| | | ODDS PAID | HOUSE % PROFIT |
|---|---|---|---|
| 39 | Red | 1/1 | 11.4 |
| 25 | Green | 2/1 | 14.8 |
| 15 | Purple | 4/1 | 14.8 |
| 8 | Orange | 8/1 | 18.2 |
| 1 | Stripe | 70/1 | 19.3 |

The compartments on the wheel are numbered 1–24, the 25th number being striped. For betting on the destination of the ball on the wheel, the odds for successful selection of any compartment are 20/1 and the house profit is 4%.

Players may enjoy significantly greater odds by betting on a combination of a colour and a number. For example assuming a bet that a particular colour of ball falls into a particular identified compartment the odds paid are:

| | ODDS PAID | HOUSE % PROFIT |
|---|---|---|
| Red on particular number | 40/1 | 31.0 |
| Green on particular number | 60/1 | 27.9 |
| Purple on particular number | 80/1 | 41.1 |
| Orange on particular number | 100/1 | 63.3 |
| Stripe on particular number | 888/1 | 59.6 |

Players can thus choose to wager against low, moderate or high odds.

The margin of return to the house or to a player can be easily adjusted by variation to both the number of balls, the colour of the balls etc. In addition jack pot prizes can be paid.

It will be understood that in other embodiments of the invention the balls may be randomly mixed by other means for example by shaking or by rotation in a closed container. In a preferred embodiment of the invention the balls are circulated by air pressure until randomly distributed in a transparent container shaped to correspond to the word "fortune" or to a character or ideograph conveying that meaning. Alternatively the balls can be circulated in a container of cylindrical cross-section which forms the "o" of "fortune" or of tubular shape which forms the "i" of "win".

Container 1 may be provided with any suitable means whereby a single ball may be selected automatically and at random. In other embodiments container 1 may be provided with forms of gate or the like differing from that illustrated and which allow a single randomly selected ball to exit the container. For example as in the game "lotto" as shown on television, a single ball selected at random may be cupped by arms at the mouth of a hollow tube which is driven upwardly from the floor of a container through a layer of balls until the selected ball is above the level of the remainder whereupon the arms pivot outwardly releasing the ball to fall into the tube whereby the randomly selected ball is conducted out of the container. Any other suitable means for selecting a single ball at random may be substituted and desirably is suitably automated. Usually the selection will be actuated by a "Game Compere" at a time after the random mixing has commenced to ensure that substantial randomisation has occurred. However the selection may be made after a time interval chosen at random or by other means. Chamber 1 may be provided with a filling port to facilitate replacement of balls.

In the embodiments described the first set of elements are balls divided into subsets by colour and the destinations are compartments on a roulette wheel distinguishable by number.

It will be understood that the elements of the first set need not be balls and non-spherical shaped set members, for example cylindrical, could be employed. Nor need the subsets be distinguished by colour. For example, if desired the subsets could be distinguishable one from another by numerals or other indicia. The number of elements constituting the first subset, the number of subsets, and the number of members within each subset is a matter of choice provided that there are at least 2 subsets.

Likewise the wheel may have any number of compartments ("destinations") and these may be associated with colours (eg. red and black) as well as, or instead of, with numbers. There may be any suitable number of destinations in the second set and these may be divided into any number of subsets each subset having one or more members and identified by colour, pattern, indicia, or any other means. Although in the embodiment described surface 28 of boss 23 rotates with wheel 24 in other embodiments a stationary surface 28 may be provided wheel 23 being spun about a bearing on a stationary boss 24. Alternatively a surface 28 may be driven in counter rotation to wheel 23 for example by means of a concentric counter rotation axle. Although it is preferred that the randomly selected ball bounces a number of times before settling in one or other compartment and preferably bounces in the vertical plane, in other embodiments the randomly selected ball from the first compartment may be discharged tangentially into a roulette type wheel before becoming associated at random with or other slot of the roulette type wheel.

The destinations of the second set need not be associated with a wheel and other apparatus fulfilling a similar function may be used. For example a vibrating board provided with a set of pockets or a pin-ball board arrangement with various channels could be used. In this case the randomly selected ball of the first set falling on to the board would be received in one or another pocket or channel destination at random. Although in the embodiment described wheel 23 is set spinning, in other embodiments the wheel may be stationary and reliance is placed on random bouncing and/or rotation of surface 28 to produce a random association with a compartment.

It will be understood that although the first chamber is described as cylindrical it may in fact be spherical or of a different shape. The walls need not be transparent but the chamber may be provided instead with suitable windows. Likewise, although chamber 20 is described as cylindrical it may be of other suitable cross-sections for example it may be a polygon in plan and may be provided with suitable veins or baffles to change the direction of ball bounce. Although in the described embodiment the compartments are segment-shaped and or equal area they need not be.

In a preferred method of playing the game of the invention the apparatus is televised and players in the TV studio or in a casino, or viewing the game on television screens at home, or in clubs, hotels, TABs or the like are at liberty to place bets upon the outcome of the game. Bets can be placed by telephone, interactive cable TV, computer linkage, or by conventional means using TAB, club, or hotel facilities where this is legal and where suitable credit arrangements have been made.

If desired the game can be played repeatedly at intervals. If desired the game can be transmitted via internet and can be played by computer users.

The winning combinations, and the pay out ratios if the game is used for betting, may be altered as desired.

In a less preferred embodiment the invention extends to electronic versions of the game in which a first set of elements divisible into two or more subsets are depicted on a computer screen or the like. Means are provided whereby one element may be selected at random and then associated with one of a plurality of "destination" depictions.

As will be apparent to those skilled in the art from the teaching hereof the invention maybe embodied in other forms without departing from the novel concept herein disclosed.

What is claimed is:

1. Apparatus comprising a first set of elements divisible into two or more visually distinguishable subsets, a second set of destinations divisible into two or more distinguishable subsets, means for selecting and isolating at random one element from the first set, and means for associating said randomly selected one element at random with one destination of the second set.

2. Apparatus according to claim 1 wherein the first set of elements is a plurality of balls.

3. Apparatus according to claim 2 wherein the set of balls is divided into a plurality of subsets each subset being visually distinguishable from each other by colour or pattern.

4. Apparatus according to claim 1 wherein the second set of destinations is set of compartments or slots defined on a wheel.

5. Apparatus according to claim 4 wherein the destinations are distinguished one from another by numerical indicia.

6. Apparatus according to claim 4 wherein the wheel is partitioned radially into segment shaped upwardly open compartments.

7. Apparatus according to claim 4 wherein the first set of elements are balls and wherein a ball selected at random from the first set is allowed to travel in a path which includes at least one random bounce prior to the ball selected settling at random in one of the compartments.

8. Apparatus according to claim 7 further comprising means to set the wheel in rotation prior to allowing the selected ball to settle at random into one of the compartments.

9. Apparatus according to claim 4 wherein the wheel comprises a central boss.

10. Apparatus according to claim 9 wherein the central boss rotates with the heel.

11. Apparatus according to claim 8 wherein the central boss rotates counter to the direction of rotation of the wheel.

12. Apparatus according to claim 1 further comprising a chamber, means for randomly mixing the first set of elements in the chamber, and means for removing one element selected at random from the chamber.

13. Apparatus according to claim 7 wherein the selected ball bounces in a vertical plane prior to settling at random into one of the compartments.

14. Apparatus substantially as herein described with reference to any one of the examples.

15. Apparatus according to claim 5 wherein the wheel is partitioned radially into segment shaped upwardly open compartments.

16. Apparatus according to claim 5 wherein the first set of elements are balls and wherein a ball selected at random from the first set is allowed to travel in a path which includes at least one random bounce prior to the ball selected settling at random in one of the compartments.

17. Apparatus according to claim 6 wherein the first set of elements are balls and wherein a ball selected at random from the first set is allowed to travel in a path which includes at least one random bounce prior to the ball selected settling at random in one of the compartments.

18. Apparatus according to claims 5 wherein the wheel comprises a central boss.

19. Apparatus according to claims 6 wherein the wheel comprises a central boss.

20. Apparatus according to claim 8 wherein the selected ball bounces in a vertical plane prior to settling at random into one of the compartments.

21. An apparatus comprising:

a first set of elements randomly disposed within a first area, said first set being divisible into two or more visually distinguishable subsets, a second set of destinations divisible into two or more discrete and distinguishable subsets, means for selecting and isolating at random one element from the first set and the first area, and means for randomly associating said randomly selected one element with and randomly distributing said randomly selected one element to one destination of the second set separate and apart from said first set and said first area.

22. An apparatus comprising:

a first set of elements divisible into two or more visually distinguishable subsets, a second set of destinations divisible into two or more distinguishable subsets, means for selecting and isolating at random one element from the first set, said means for selecting and isolating comprising a movable element that delivers said one element from a first area containing the first set of elements to a second area containing the second set of destinations, and means for associating said randomly selected one element at random with one destination of the second set.

23. The apparatus according to claim 22, wherein said movable element comprises a rotating disk isolating said first area from said second area, said rotating disk receives said one element at an exit of said first area then delivers said one element to said second area.

* * * * *